United States Patent [19]

McQuain

[11] Patent Number: 4,860,776

[45] Date of Patent: Aug. 29, 1989

[54] SHIELD FOR A PERSON

[75] Inventor: Beverly A. McQuain, Morriston, Canada

[73] Assignee: Instant Defence Inc., Toronto, Canada

[21] Appl. No.: 945,714

[22] Filed: Dec. 23, 1986

Related U.S. Application Data

[63] Continuation-in-part of Ser. No. 860,943, May 2, 1985, abandoned.

[51] Int. Cl.[4] ..... A45B 13/00; A45B 25/14

[52] U.S. Cl. ..... 135/19.5; 135/16; 135/24

[58] Field of Search ..... 294/131; 224/907; 135/16, 19.5, 20 M, 22, 24, 28, 33, 34, 37, 38, 41

[56] References Cited

U.S. PATENT DOCUMENTS

| | | | |
|---|---|---|---|
| 66,632 | 7/1867 | Robbins | 135/31 X |
| 257,884 | 5/1882 | Miniere | 135/34 |
| 337,276 | 3/1886 | Meyer, Jr. | 135/22 |
| 521,828 | 6/1894 | Sprague | 135/24 |
| 601,096 | 3/1898 | Hager | 135/22 |
| 735,776 | 8/1903 | Kaltenecker | 135/24 |
| 1,070,894 | 8/1913 | Hopkins | 135/22 |
| 1,109,854 | 9/1914 | McCabe | 135/22 |
| 1,202,063 | 10/1916 | Heyn | 135/41 |
| 2,906,277 | 9/1959 | Militano | 135/22 |
| 3,856,030 | 12/1974 | Sato | 135/22 |
| 3,873,821 | 3/1975 | Larson | 135/34 X |
| 4,041,966 | 8/1977 | Sakurai | 135/22 |
| 4,240,454 | 12/1980 | Tsai | 135/24 |
| 4,534,374 | 8/1985 | Day | 135/22 |

FOREIGN PATENT DOCUMENTS

| | | | |
|---|---|---|---|
| 28807 | of 0000 | Fed. Rep. of Germany | 135/24 |
| 2036356 | 7/1970 | Fed. Rep. of Germany | 135/24 |
| 73979 | 10/1960 | France | 135/24 |
| 407640 | 11/1944 | Italy | 135/24 |

*Primary Examiner*—Mickey Yu
*Assistant Examiner*—D. Neal Muir
*Attorney, Agent, or Firm*—Rogers, Bereskin & Parr

[57] ABSTRACT

A shield for a person has a shaft, a handle and a release trigger in the shaft. A plurality of ribs are pivotally attached to the shaft at the other end from the handle. A support is provided for the ribs and is movable between an open configuration in which the ribs extend mainly radially outwards and a closed configuration in which the ribs are adjacent the shaft. The release trigger holds the support in the closed configuration. A spring is provided for urging the support from the closed to the open configuration. A flexible cover is attached to the ribs, and the shield is dimensioned to withstand the impact from a large object, such as a dog, or a missile thrown at the shield.

23 Claims, 5 Drawing Sheets

100
104
6
10
92
1
2
90
4
112
110
114
16
50
44
42
52
14
12
98
39
36
40

SHIELD FOR A PERSON

CROSS-REFERENCE TO RELATED APPLICATION

This application is a continuation-in-part of application Ser. No. 860,943, filed May 2, 1985, now abandoned.

FIELD OF THE INVENTION

This invention relates to a shield for a person. This invention more particularly relates to a dog or other animal shield, for use by people whose occupation involves the possibility of encountering dogs.

BACKGROUND OF THE INVENTION

At the present time, one group of people who frequently encounter dogs in the course of their work are postmen. Dogs are commonly kept as household pets. Whilst many dogs can be good natured with their owners and people they are familiar with, they can be extremely aggressive to strangers. Also, many dogs have a strong territorial instinct, which again leads them to be extremely aggressive to strangers.

As a result, many postmen are attacked by dogs as they attempt to deliver mail. Postmen have adopted a variety of measures to counter this problem. One technique is to carry a conventional umbrella. The umbrella is opened in the face of a charging or aggressive dog. The sudden opening of the umbrella will in some cases startle the dog away. However, in many cases it is ineffective. The umbrella does not make any significant noise to assist in startling the dog. Also, conventional umbrellas are usually made of a fairly dark material, which again does not assist in startling the dog. If the dog is not deterred by the umbrella, then conventional umbrella structures are far too lightweight to resist damage by a determined dog. The cover material is light and easily torn, and the supporting rib structure cannot withstand the sort of loads applied by a medium or large size dog.

Further, many conventional umbrellas have a pointed end to the shaft. This can injure a dog. As most dogs are kept as domestic pets, it is desirable that any method of deterring attacks by a dog should not injure the dog.

What is required is an animal shield, which is lightweight, compact and easily carried. It should be capable of quick and easy deployment. Further, it should be capable of withstanding the loads or forces applied by dogs or other animals of concern.

Further, it is to be borne in mind that dogs are colourblind. The vision of dogs and other animals is much more sensitive to light than humans, and this effect should be utilized.

Also, policemen, penitentiary guards and the like sometimes encounter hostile situations, where missiles, such as rocks, bottles, etc. are thrown at them. It is desirable to have available a shield which can be collapsed to a compact portable configuration, but which can be readily deployed.

SUMMARY OF THE PRESENT INVENTION

In accordance with the present invention, there is provided a shield for a person, the shield comprising: a rigid shaft; a handle means at one end of the shaft; a release trigger; a plurality of substantially rigid ribs pivotally attached to the shaft adjacent another distal end thereof; substantially rigid support means supporting the ribs and movable between an open, stable configuration in which the ribs extend substantially radially out from the shaft and a closed configuration in which the ribs are adjacent the shaft, the release trigger holding the support means in the closed configuration; biasing means urging the support means from the closed to the open, stable configuration; and a high strength flexible cover attached to the ribs, the shield and cover being sufficiently strong in the open configuration to withstand impact from a large heavy, blunt object.

It is anticipated that the shield can be used as a dog or other animal shield. The shield can include other preferred features. The release trigger in the handle means can be operable by simply gripping the handle means. Preferably, the ribs and the support means should be formed from high carbon steel, and the cover made from a strong "parachute-type" nylon. The cover should be resistant to tearing. When used as a dog or other animal shield, the support means should provide an audible snap, as the shield reaches the open configuration, to provide an additional deterrent. The cover is preferably made form a fluorescent material, to partially "blind" a dog. Additionally, the shield can include a second release trigger provided at the other end of the shaft. This second release trigger when displaced axially towards the one end of the shaft releases the support means, so that it is moved from its closed to open configurations under the action of the spring biasing means. This enables a user to open the animal shield simply by pressing this second release trigger against a dog or other animal.

It is envisaged that the shield could be used for other purposes, for example by policemen and the like to protect themselves from objects thrown at them. In this case, the shield would be dimensioned accordingly, and generally would be larger than a dog shield.

BRIEF DESCRIPTION OF THE DRAWINGS

For a better understanding of the present invention, and to show more clearly how it may be carried into effect, reference will now be made, by way of example, to the accompanying drawings, in which.

Figure 1A:
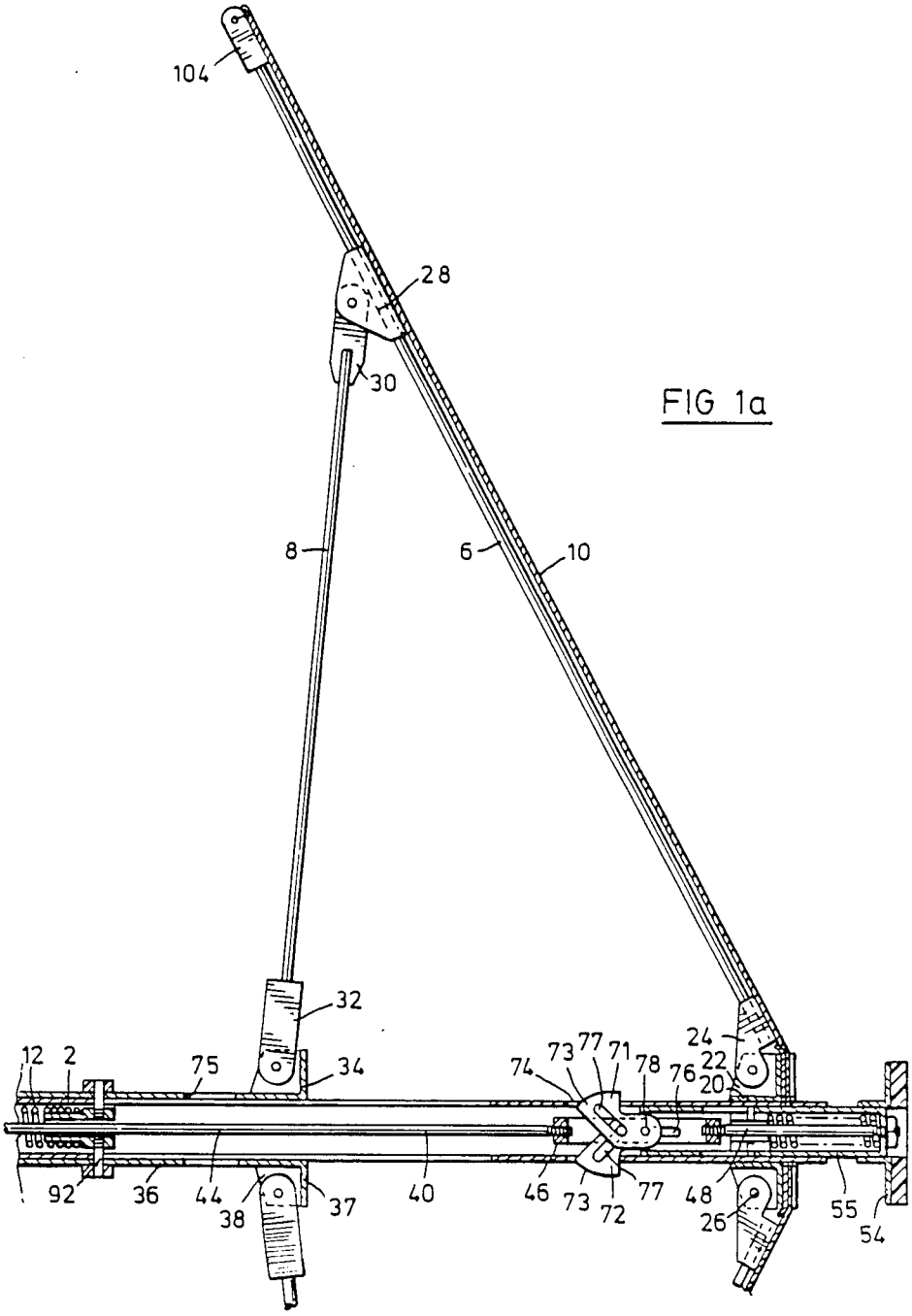
FIG. 1*a* shows a sectional view of part of a shield in an open configuration along an axis of the shaft thereof.

In the drawings, a shield is generally denoted by the reference 1. Here, the shield is configured as a dog shield, and is described in use with dogs. However, it is to be appreciated that the shield could be used for other purposes. For other uses, the dimensions of the various components should be chosen appropriately.

The shield 1 includes a tubular shaft 2, with a handle 4 mounted at one end of the shaft 2. A plurality of ribs 6 are pivotally attached to the other end of the shaft 2, as detailed below. Supporting struts 8 are provided for supporting the ribs 6 and again this mechanism is detailed below. A cover 10 is secured to the ribs 6.

Within the tubular shaft 2, there is a tension spring 12 for urging the ribs 6 and support struts 8 to an open configuration. This tension spring 12 is controlled by a release mechanism generally indicated at 14, which is connected to a first release trigger 16 mounted in the handle 4.

At the right-hand end of the shaft 2, as viewed in FIG. 1, there is a first, fixed bracket 20, for the ends of the ribs 6. As shown in the section of FIG. 1, this bracket 20 has a L-section which extends in a full circle, and the bracket 20 is secured, as by screws, to the end of the shaft 2. The bracket 20 also includes radially extending flanges 22. The inner end of each rib 6 is provided with a connecting member 24 which is folded around the end of the rib 6, to form a U-shape. This U-shape connecting member 24 has two flanges which are pivotally connected to the respective flange 22, as indicated at 26.

Correspondingly, towards the outer end of each rib 6, there is a second connecting member 28. This again is U-shape and has a pair of flanges. A free end of a respective supporting strut 8 has a sheet flange member 30 brazed to it. The flange member 30 is received between the limbs of the connecting member 28 and is pivotally connected to it.

At the inner end of each strut 8, there is a third connecting member 32, which again is U-shape. However, the end of the strut 8 extends through the base of the U-section, rather than being enclosed by it. A second, sliding bracket 34 is slidably mounted on the shaft 2. The second sliding bracket 34 is similar at one end to the first bracket 20. Thus, the second bracket 34 includes a tubular body 36, an annular flange 37 and individual radially extending flanges 38, each flange 38 being pivotally connected to one third connecting member 32, similarly to the arrangement for the first bracket 20. The tubular body 36 bears a handle portion 39, including annular ribs.

The release mechanism 14 within the shaft 2 includes a rod 40 extending the length of the shaft 2 and having various segments. Thus, at one end the rod 40 includes a cylindrical plug 42, which is slidably mounted in the shaft 2. A rod element 44 is secured to the plug 42, and extends through the spring 12. The other end of the rod element 44 is secured to a connection element 46 that has two parallel sides defining a slot. The other end of the connection element 46 is secured to a second rod element 48. The rod 40 is arranged for axial movement within the shaft 2 to actuate the shield, as detailed below.

The first release trigger 16 is pivotally mounted at its forward end, as indicated at 50. A L-shape crank member 52 is pivotally mounted in the handle 4 and has one limb abutting the under side of the trigger 16. The other limb engages a bore in the cylindrical plug 42. Consequently, when the handle 4 is gripped, the rear of the trigger 16 is pressed inwards. This causes the crank member 52 to rotate clockwise, thereby causing the plug 42 and rod 40 to travel to the left.

Figure 3:
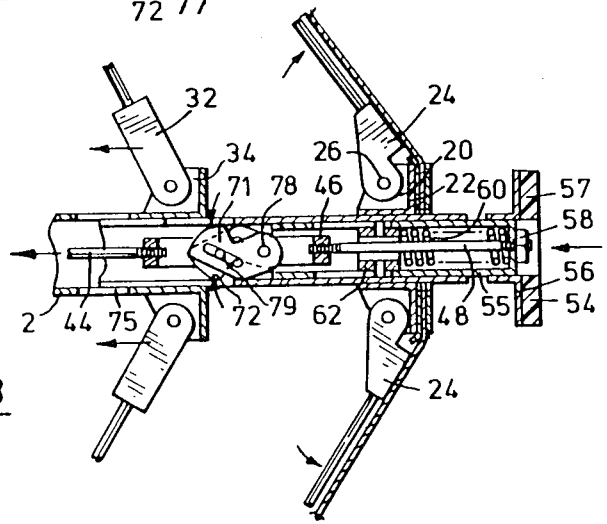
FIG. 3 shows part of the sectional view of FIGS. 1*a* and 2, showing operation of the shield.

At the right-hand end of the shaft 2, a second release trigger 54 is provided (FIG. 3). This second release trigger 54 comprises a tubular section 55 slidably received within the shaft 2 and an annular flange 56. A circular or annular pad of slightly resilient material 57 is provided at the end of the second release trigger 54. The second rod element 48 extends through the second release trigger 54 and is secured thereto by a nut 58. A compression spring 60 is provided between the second release trigger 54 and a sleeve member 62. The sleeve member 62 is secured relative to the tubular shaft 2, as by screws extending through elongate slots in the tubular section 55. The compression spring 60 maintains the second trigger 54 against the nut 58.

Within the connection element 46, there is a catch mechanism 70. This catch mechanism 70 comprises two plates 71, 72 which are generally symmetrical about the axis of the device. The plates have respective catch surfaces 73, which are arcuate and include a step at one end. The catch surfaces 73, in the closed configuration of FIG. 2, extend through slots 74 of the shaft 2 and slots 75 of the sliding bracket 34; the catch surfaces 73 thereby engage the bracket 34 to hold it against the action of the spring 12. The plates 71, 72 are pivotally attached to the shaft 2 by a first pivot 78, which extends through slots 76 in the connection element 46. A second pivot 79 is provided on the connection element 46. This second pivot 79 extends through elongate slots 77 in the plates 71, 72. In use, when the connection element 46 travels to the left, the pivot 79 travels down the slots 77. Initially, the slots 79 are in the inclined configuration shown in FIG. 2. Consequently, as the pivot 79 travels axially it draws the plates 71, 72 in to the tubular shaft 2, until they no longer project out from it, as shown in FIG. 3. This then releases the second, sliding bracket 34. In the configuration shown in FIG. 2, the catch surfaces 73 are fully extended out through the slots 74, 75 in a tube 2 and bracket 34, to restrain the bracket 34.

Figures 1B, 4, 5, 6:
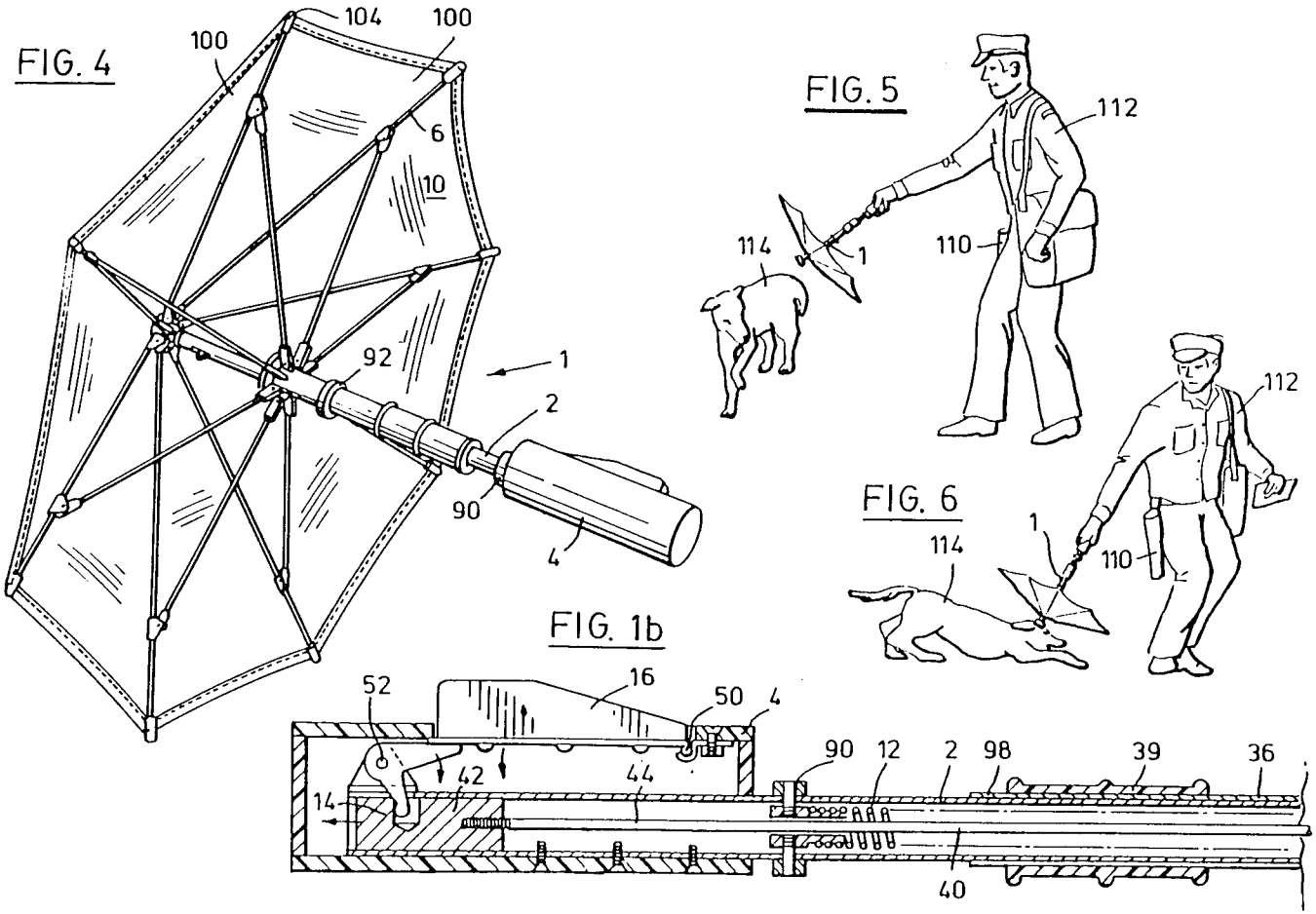
FIG. 1*b* shows a sectional view of the handle of the shield of FIG. 1 along the axis thereof.
FIG. 4 shows a perspective view of the shield from behind.
FIGS. 5 and 6 show perspective views of shield used by a person against a dog.

To actuate the mechanism, the tension spring 12 is provided. At one end, the tension spring 12 is secured to a mounting member 90, which is secured to the shaft 2 by screws passing through a collar around the shaft 2. The mounting member 90 has a bore through which the rod element 44 extends. At its other end, a similar mounting member 92 connects the tension spring 12 to the second sliding bracket 34, the mounting member 92 being secured by screws 94. The screws 94 are located in elongate slots 96 in the tubular shaft 2. Consequently, the second sliding bracket 34 and the mounting member 92 can freely slide along the shaft 2, within limits set by the length of the slots 96. To limit the leftward travel of the sliding bracket 34, a collar 98 is provided around the shaft 2. The handle portion 39 abuts this collar 98, in the open configuration (FIG. 1*b*).

The cover 10 is formed from a number of generally triangular segments 100, which are stitched together along seams extending immediately above the ribs 6. The center of the cover 10 can be reinforced on both sides by annular leather discs 102. The free ends of the ribs 6 are provided with end caps 104, which are slid onto the ends and include small bores for thread. These bores are then used to tie edges of the cover 10 to the ends of the ribs 6.

Figure 2:
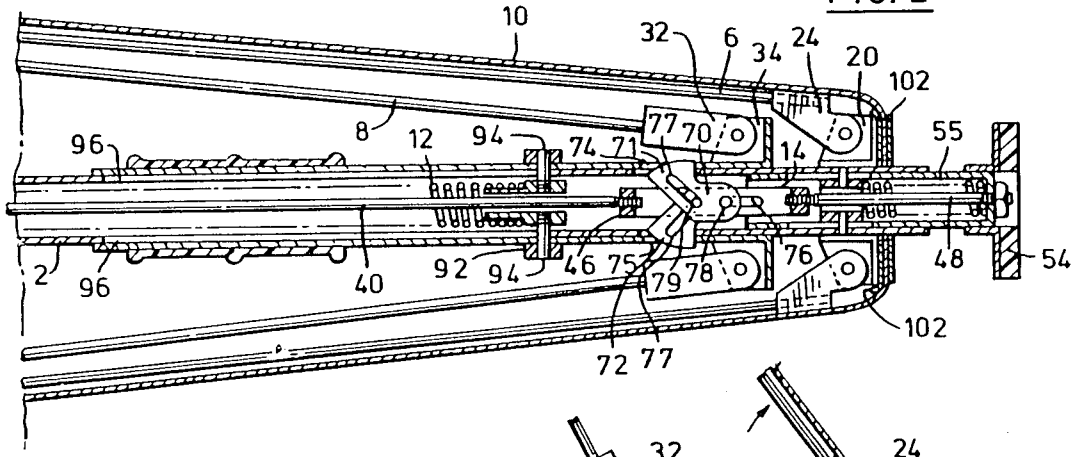
FIG. 2 shows a sectional view, similar to FIG. 1, of part of the shield in a closed configuration.

In the closed position shown in FIG. 2, the spring 12 is tensioned, and the sliding bracket 34 held adjacent the fixed, first bracket 20. It is held by the plates 71, 72. The plates 71, 72 are in turn held in position by the release mechanism 14. The compression spring 60 of the release mechanism maintains the plates 71, 72 in this position.

To release the spring 12 and to deploy the shield 1, either of the triggers 16, 54 are used. The first trigger 16 is operated simply by squeezing the trigger 16 together with the handle 4. A second release trigger 54 is operated by striking the trigger 54 against an object, e.g. by pressing it against an attacking dog. Either of these actions causes the rod 40 of the release mechanism 14 to be urged to the left.

As shown in FIG. 3, this causes the pivot 79 to travel down the slots 77, thereby withdrawing the catch surfaces 73 into the shaft 2. The second bracket 34 is released. The spring 12, which preferably provides a high tension, then drives the sliding bracket 34 towards the handle 4. This simultaneously pushes the support struts 8 and hence the ribs 6 outwards. The bracket 34 continues to travel rapidly under the influence of the spring 12, until it reaches the collar 98.

It is preferred, at least for a dog or other animal shield, that the handle portion 39 and collar 98 should strike each other audibly as the shield opens. This then produces an audible snap or other sound, as an additional deterrent.

The shield is then in an open configuration as shown in FIGS. 1*a*, 1*b* and 4. The struts 8 extend generally radially outwards. The ribs 6 now extend outwards and are inclined at an angle to the shaft 2. This provides a secure and rigid structure. Any loads in the struts 8 are generally perpendicular to the shaft 2, thereby not tending to move the bracket 34. Any residual, non-perpendicular compression loads in the struts 8 urge the bracket 34 more firmly against the collar 98.

To close the shield, the handle 4 is gripped in one hand and the handle portion 98 in the other hand. The handle portion 98 is then urged firmly away from the handle 4. This motion is continued, until the bracket 34 rides over the catch surfaces 73. As the bracket 34 passes over the catch surfaces 73, it will displace the plates 71, 72 sufficiently to enable the bracket 34 to pass. The catch surfaces 73 then spring back into the slots 75. Consequently, when the handle portion 98 is released, the shield is in the cocked or closed configuration of FIG. 2.

To carry the shield, a carrying pouch or sheath 110 is provided, as shown in FIGS. 5 and 6. This carrying pouch 110 can be formed from leather or other suitable material, and includes a loop for mounting it on a person's belt. Preferably, this loop includes snap fasteners, to enable it to be opened, to fit around the belt. FIGS. 5 and 6 show the shield 1 in use. The shield 1 is carried by a postman indicated schematically at 112, who is shown using the shield 1 against a dog 114.

Usually, the postman 112 will carry the shield 1 in the collapsed configuration of FIG. 2 in the pouch 110, with the handle 4 exposed. Then, if the postman 112 encounters an aggressive dog 114, he can quickly pull the shield 1 from its pouch 110. The shield 1 is then opened by gripping the first release trigger 16, or by pressing the second release trigger 54 against the dog 114.

As shown in FIG. 5, the postman 112 can then use the shield 1 to prevent the dog 114 attacking him. FIG. 6 shows how the shield 1 can be used to prevent the dog 114 from diving under the outstretched shield 1. The postman 112 can thus use the shield 1 to pin the dog 114. Similarly, the shield 1 can be used to prevent an attack from a dog, from whichever angle the dog approaches.

Figure 7:
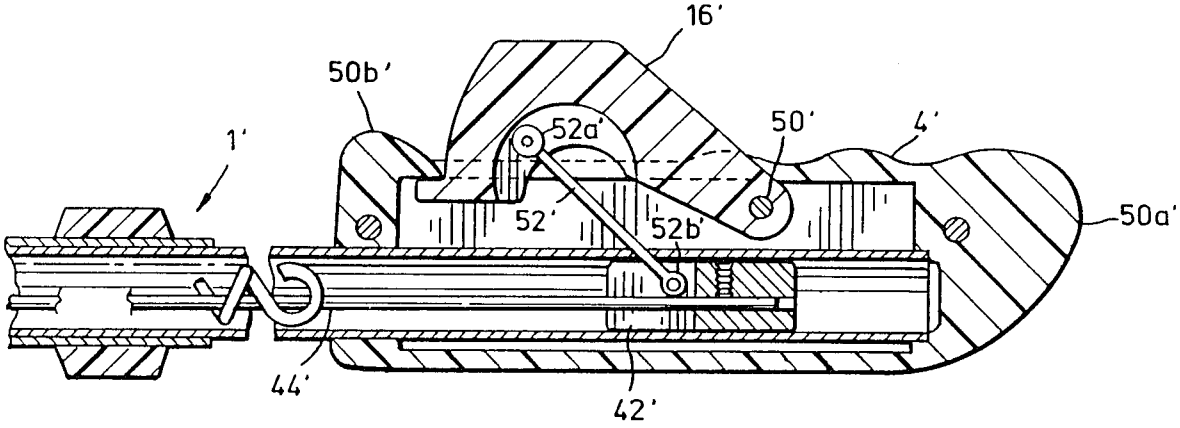
FIG. 7 shows a sectional view of the handle of a second embodiment of the invention, along the axis thereof.
Figure 8:
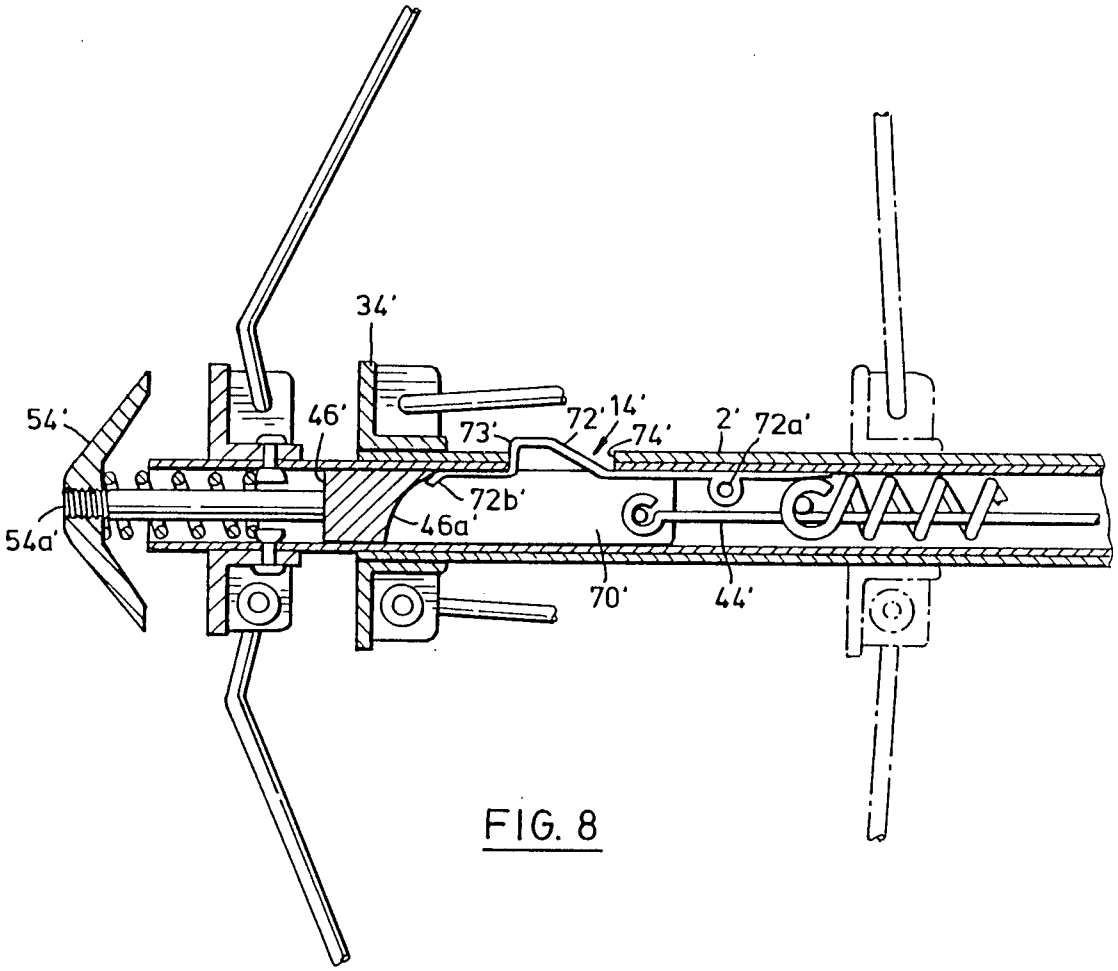
FIG. 8 shows a sectional view of the second embodiment of the invention in a closed configuration along the axis of the shaft thereof.

With regard to a second embodiment, as depicted in FIGS. 7 and 8, like numerals will refer to like components, with the addition of a prime. In FIG. 7, a handle 4' is shown. The handle 4' is formed in the shape of a grip, to facilitate the manoeuvering of the shield 1' in response to an attacking animal.

In the second embodiment, first release trigger 16' is pivotally mounted at 50', but 50' is at the bottom end 50*a'* of the handle 4', rather than at the top end 50*b'* as in the first embodiment. Cylindrical plug 42' is connected to first release trigger 16' by a straight crank 52'. Straight crank 52' is pivotally mounted at each end 52*a'* and 52*b'*. Rod element 44' is secured to cylindrical plug 42'.

It will now be appreciated that when first release trigger 16' is depressed, it rotates about pivot 50' and drives crank 52' towards the bottom end 50*a'* of handle 4'. Consequently, cylindrical plug 42' is driven rearwardly.

Turning now to FIG. 8, the release mechanism 14' can now be described. It will be noted that second release trigger 54' is in the form of a cone, with a gently rounded point 54*a'*. Cone 54' is internally threaded, to receive a mandrel 46' which is analogous to a combination of second rod element 48 and connection element 46 of the first embodiment.

In this second embodiment, tubular shaft 2' is provided with only one slot 74'. Catch mechanism 70' comprises spring wire catch 72' which is analogous to plate 72 of the first embodiment. Spring wire catch 72' is mounted on a pin 72*a'* and has an outwardly extending partial bend which forms a catch surface 73', and terminates in a free end 72*b'*.

Mandrel 46' has curved inner surface 46*a'* which interacts with spring wire catch 72'. As can be seen from FIG. 7, when second release trigger 54' is depressed axially towards the handle 4', compressing compression spring 60', mandrel 46' is also moved axially. Curved inner surface 46*a'* of mandrel 46' then causes free end 72*b'* to be deflected inwardly which causes the outwardly extending bend of spring wire catch 72' to move inwardly. Catch surface 73' is retracted. This allows sliding bracket 34' to pass over spring wire catch 72', resulting in the shield snapping open.

It will also now be appreciated that rod element 44' is secured to mandrel 46'. As rod element 44' is drawn towards the handle 4' of the shield 1', mandrel 46' is again moved axially towards handle 4' Sliding bracket 34' is freed, and passes over spring wire catch 72', as catch surface 73' of spring wire catch 72' is retracted, resulting in the shield snapping open.

With regard to dimensions, these should be chosen to suit each individual application. However, exemplary dimensions are given below for a shield for use as a dog shield.

The overall length of the shield 1 along the axis of the shaft 2 is 19⅜". The ribs 6 are 12" long, and the struts 8 are 8" long.

Both the ribs 6 and struts 8 are formed from ⅛" diameter high carbon steel rod. The various connection elements on the ribs 6 and struts 8 are brazed in position. The shaft 2 is a ⅝" tubular shaft. The spring 12 is a 75-pound spring. All the pivots are 3/32" diameter steel roll pins.

The mechanism for the second release trigger 54 and its spring 60 are dimensioned, to release under a load of 5 pounds. The structure of the sheath or pouch 110 is such as to prevent accidental deployment of the shield 1.

The material for the cover 10 is a strong "parachute-type" nylon. It has a fluorescent finish, so as to "blind" a dog. It should be rear or rip resistant.

These dimensions give a diameter in the open configuration of 23½'. Such a construction is intended to withstand a force of 150 pounds multiplied by an impact factor of 2 at right angles to the surface.

I claim:

1. A shield for a person, the shield comprising: a rigid shaft; a first handle means at one end of the shaft; a first release trigger; a plurality of substantially rigid ribs pivotally attached to the shaft adjacent another distal end of the shaft; substantially rigid support means supporting the ribs and movable between an open, stable configuration in which the ribs extends substantially radially out from the shaft and a closed configuration in which the ribs are adjacent the shaft, the release trigger holding the support means in the closed configuration; biasing means urging the support means from the closed to the open, stable configuration; and a high strength flexible cover attached to the ribs, the shield and cover being sufficiently strong in the open configuration to withstand impact from a large, heavy, blunt object.

2. A shield as claimed in claim 1, which comprises an animal shield, for shielding a person from an aggressive animal, and which is approximately two feet or less in diameter.

3. The shield as claimed in claim 1, which comprises an animal shield, for shielding a person from an aggressive animal, and which is capable of withstanding a load of three hundred pounds applied to the outside of the flexible cover and substantially parallel to the shaft.

4. A shield as claimed in claim 2, wherein the shaft has a length of approximately two feet or less.

5. A shield as claimed in claim 4, which is capable of withstanding a load of three hundred pounds applied to the outside of the flexible cover and substantially parallel to the axis of the shaft.

6. A shield as claimed in claim 1, wherein the first release trigger is mounted in the first handle means extending outwardly therefrom, the first release trigger being actuated by being depressed inwards.

7. A shield as claimed in claim 6, which includes a release mechanism including an actuating rod extending axially inside said shaft, for releasing the support means, the actuating rod being connected to the first release trigger.

8. A shield for a person, the shield comprising: a rigid shaft; a first handle means at one end of the shaft; a first release trigger mounted in the first handle means extending outwardly and being actuatable to the shaft adjacent another distal end of the shaft; support means supporting the ribs and movable between an open, stable configuration in which the ribs extend substantially radially out from the shaft and a closed configuration in which the ribs are adjacent the shaft; a release mechanism including an actuating rod extending axially inside said shaft between the support means and the first release trigger, the actuating rod being displaceable towards the first handle means to release the support means; biasing means urging the support means from the closed to the open configuration; a high strength flexible cover attached to the ribs and a second release trigger at the other end of the shaft and second spring biasing means urging the second release trigger away from the first release trigger, the second release trigger being displaceable against the action of the second spring biasing means to displace the actuating rod and thereby to release the support means, the shield being sufficiently strong in the open configuration to withstand impact from a large, heavy, blunt object.

9. A shield as claimed in claim 7 or 8, wherein the release mechanism includes catch plates, which are pivotally mounted within the shaft and are displaced by the actuating rod, and wherein the shaft includes slots, through which the catch plates project in the closed configuration.

10. A shield as claimed in claim 8, which includes a pair of catch plates that are pivotally mounted about a transverse axis within the shaft, the shaft includes respective openings for the catch plates on opposite sides of the shaft, through which openings the catch plates can extend, each catch plate includes a slot, and the actuating rod is provided with another transverse pivot located within those slots, for actuation of the catch plates in dependence upon axial movement of the actuating rod.

11. A shield as claimed in claims 7 or 8, wherein the release mechanism includes a spring catch and a mandrel, said mandrel being slidably mounted within the shaft and being axially displaced by said actuating rod, and wherein said shaft includes a slot through which the spring catch projects in the closed configuration.

12. A shield as claimed in claim 8, which includes a slot in the shaft;

a spring catch mounted within the shaft, the spring catch having a fixed end, a bend having a catch surface extending out of said slot in the closed configuration, and a free end located within said shaft; and a mandrel, said mandrel having a curved surface at one end, adjacent said free end of said spring catch and being slidably mounted within the shaft, whereby, upon said mandrel being axially displaced within the shaft by the actuator rod said curved surface of said mandrel draws said free end of said spring catch inwardly, thereby retracting said catch surface of said bend into said slot.

13. A shield as claimed in claim 1, which includes a first, fixed bracket at the other end of the shaft, to which the ribs are pivotally attached, and wherein the support means comprises a second bracket slidably mounted on the shaft and a plurality of struts, each of which struts is pivotally attached at one end to the sliding bracket and is pivotally attached at the other end to a respective rib.

14. A shield as claimed in claim 10, wherein a first bracket is secured to the other end of the shaft, with the ribs pivotally attached to the first bracket, and wherein the support means comprises a second bracket slidably mounted on the shaft and a plurality of struts, each of which struts is pivotally attached at one end to the second bracket and is pivotally attached at the other end to a respective rib.

15. A shield as claimed in claim 13 or 14, wherein the second bracket is located adjacent the first bracket in the closed configuration, and is displaced towards the first handle means when moving to the open configuration.

16. A shield as claimed in claim 13 or 14, wherein the second bracket includes a second handle means for actuation thereof.

17. A shield as claimed in claim 13 or 14, which includes a collar secured to the shaft, for limiting the movement of the second bracket, the collar and the second bracket cooperating with one another when the shield adopts the open configuration, to produce an audible noise.

18. A shield as claimed in claim 13 or 14, wherein the biasing means comprises a tension spring mounted within the shaft and around the rod, the tension spring being secured at one end by one mounting member to the shaft adjacent the first handle means and at the other end by another mounting member to the second bracket, which other mounting member extends through slots in the shaft.

19. A shield as claimed in claim 14, wherein the second bracket in the closed configuration is adjacent the first bracket and is urged by the biasing means towards the first handle means when adopting the open configuration, wherein the second bracket includes a second handle means and a collar is provided around the shaft to limit the travel of the second handle means, the collar and the second handle means co-operating to produce an audible noise as the shield adopts the open configuration, and wherein the biasing means comprises a tension spring mounted at one end by one mounting member to the shaft adjacent the first handle means and at the other end by another mounting member to the second bracket, which other mounting member extends through slots in the shaft.

20. A shield as claimed in claim 1, 8, or 14, wherein the cover comprises a fluorescent, high strength woven nylon material.

21. A shield for a person, the shield comprising: an elongate shaft; a first handle means at one end of the shaft; a first release trigger mounted in the first handle means, and actuable by being displaced radially inwards by gripping the first handle means together with the first trigger means; an actuating rod extending within the shaft and connected at one end to the first trigger means, so as to be displaced by the first trigger means towards the first handle means; a second trigger means slidably mounted adjacent another distal end of the shaft remote from the first handle means and connected to the actuating rod, and for displacing the actuating rod towards the first handle means; a compression spring within the shaft urging the actuating rod and the second trigger means away from the first handle means; a pair of catch plates pivotally mounted within the shaft about a transverse axis, and including elongate slots, with the actuating rod including a transverse pivot in the elongate slots, to actuate the catch plates, and with the shaft including slots through which the catch plates can extend; a first bracket secured adjacent the other distal end of the shaft; a plurality of ribs pivotally attached to the first bracket; a second bracket slidably mounted on the shaft; a plurality of struts, each of which struts is pivotally attached at the other end to a respective rib; a tension spring within the shaft, secured at one end to the shaft and at the other end to the second sliding bracket; and a high strength flexible cover attached to the ribs, the shield being sufficiently strong to withstand impact from a large, heavy, blunt object in the open configuration.

22. A shield for a person, the shield comprising: an elongate shaft; a first handle means at one end of the shaft; a first trigger means mounted in the first handle means, and displacable radially inwards by gripping the first handle means together with the first trigger means; an actuating rod extending within the shaft and connected at one end to the first trigger means, so as to be displaced by the first trigger means towards the first handle means when the first trigger means is displaced radially inwards; a second trigger means slidably mounted adjacent another distal end of the shaft remote from the first handle means and connected to the actuating rod, for displacing the actuating rod towards the first handle means; a compression spring within the shaft urging the actuating rod and the second trigger means away from the first handle means; a spring catch mounted with in the shaft and having a fixed end, a free end, and between the fixed and free ends a bend with a catch surface, said shaft having a slot through which said bend can extend, and a mandrel axially mounted within the shaft actuated by the actuating rod and having a curved surface adjacent said free end of said spring catch; a first bracket secured adjacent the other distal end of the shaft; a plurality of ribs pivotally attached to the first bracket; a second bracket slidably mounted on the shaft; a plurality of struts, each of which struts is pivotally attached at one end to the second bracket and is pivotally attached at the other end to a respective rib; a tension spring within the shaft, secured at one end to the shaft and at the other end to the second slding bracket; and a high strength flexible cover attached to the ribs, the shield being sufficiently strong to withstand impact from a large, heavy object in the open configuration.

23. A shield as claimed in claim 1, 8 or 3, wherein the flexible cover is formed from a high strength, tear-resistant woven material.

* * * * *